US008910556B2

(12) United States Patent
Umphries et al.

(10) Patent No.: US 8,910,556 B2
(45) Date of Patent: Dec. 16, 2014

(54) BOTTOM HOLE FIRING HEAD AND METHOD

(71) Applicants: Don Umphries, New Iberia, LA (US); Gabe Williger, Dallas, TX (US)

(72) Inventors: Don Umphries, New Iberia, LA (US); Gabe Williger, Dallas, TX (US)

( * ) Notice: Subject to any disclaimer, the term of this patent is extended or adjusted under 35 U.S.C. 154(b) by 143 days.

(21) Appl. No.: 13/694,319

(22) Filed: Nov. 19, 2012

(65) Prior Publication Data

US 2014/0137723 A1 May 22, 2014

(51) Int. Cl.
*E21B 29/02* (2006.01)
*E21B 43/112* (2006.01)

(52) U.S. Cl.
CPC ..... *E21B 29/02* (2013.01)
USPC ..... 89/1.15; 175/4.54; 175/2

(58) Field of Classification Search
CPC ..... E21B 43/116; E21B 43/119; E21B 7/00; F42B 3/00
USPC ..... 89/1.15, 1.151; 102/314, 321, 321.1; 299/13; 175/2, 4.5, 4.54–4.59
See application file for complete search history.

(56) References Cited

U.S. PATENT DOCUMENTS

| | | | | | |
|---|---|---|---|---|---|
| 4,484,632 | A | * | 11/1984 | Vann | 166/297 |
| 4,531,590 | A | * | 7/1985 | Peterson | 175/4.52 |
| 4,544,034 | A | * | 10/1985 | George | 166/297 |
| 4,564,076 | A | * | 1/1986 | Vann et al. | 175/4.52 |
| 4,690,227 | A | * | 9/1987 | George et al. | 175/4.56 |
| 4,901,802 | A | | 2/1990 | George et al. | |
| 4,924,952 | A | * | 5/1990 | Schneider | 175/4.54 |
| 5,355,957 | A | | 10/1994 | Burleson et al. | |
| 5,490,563 | A | | 2/1996 | Wesson et al. | |
| 5,571,986 | A | | 11/1996 | Snider et al. | |
| 5,603,384 | A | * | 2/1997 | Bethel et al. | 175/4.54 |
| 8,763,507 | B2 | * | 7/2014 | Ross | 89/1.15 |

* cited by examiner

*Primary Examiner* — Jonathan C Weber
(74) *Attorney, Agent, or Firm* — W. Allen Marcontell

(57) ABSTRACT

Detonation of a perforating gun is initiated by engagement of the lower distal end of the gun assembly against a bottom hole bore plug. A fluid pressure actuated firing head is initiated by well fluid that is pressurized by a free piston having an integral rod projecting from the distal end of the gun assembly. The piston is displaced against a closed fluid volume when the projecting rod engages the bore plug.

7 Claims, 2 Drawing Sheets

BOTTOM HOLE FIRING HEAD AND METHOD

CROSS-REFERENCE TO RELATED APPLICATION

Not applicable

BACKGROUND OF THE INVENTION

1. Field of the Invention

The present invention relates generally to methods and apparatus for detonating downhole explosives such as well perforating guns proximate of well terminus structure.

2. Description of Related Art

After a well is drilled, the open well bore is often cased to maintain the integrity of the production face. Some well completion procedures may include bottom hole plug structure to seal the well bore below a fluid mineral bearing production zone. That portion of the casing length adjacent to the production zone is perforated to admit the flow of in situ formation fluids into the casing bore. In other well completion procedures, the in situ fluid may be produced from an uncased production face. In either case, the in situ formation fluid is delivered to the well surface along the bore of a production tube that is suspended from the surface along the axial length of the well.

The production tube often penetrates a packer structure which seals the annulus between the outer perimeter of the production tube and the interior of the casing or raw bore wall above the formation fluid production zone. Below the formation production zone, the production tube may be plugged.

Like the casing, the production tube wall is perforated along that length section proximate of the formation production face to admit entry of formation fluid into the tube flow bore.

Pipe and casing perforations such as described above are often produced by a multiplicity of shaped charge explosives distributed along the length and around the perimeter of a cylindrical perforating gun. Shaped charges are usually fabricated of high order explosive that are, in some circumstances, difficult to detonate. Historically, numerous techniques have been used to detonate such shaped charges. For example, perforating guns have been actuated electrically, by means of a drop bar mechanism and by fluid pressure upon a firing head. Many complex factors contribute to a decision regarding which of these firing mechanisms is most appropriate for a specific well completion. The present invention addresses a method and apparatus for activating the firing head by fluid pressure.

When a firing head is activated by annulus fluid pressure, the entire gun length and the complete well environment is also subjected to an activation pressure that is over and above the in situ well pressure. In a very deep well, the summation of both in situ pressure and activation pressure may be so great as to inhibit the shaped charge detonations and perforation depth. Increased well pressure may also crush the perforating gun or create an unwanted breach in the well casing or tubing.

SUMMARY OF THE INVENTION

One object of the present invention is a fluid pressure activated firing head that does not impose increased fluid pressure upon the perforating gun and the surrounding well environment additional to the in situ well pressure additional to the in situ well pressure.

Firing head activation pressure is generated by a piston-cylinder mechanism positioned axially adjacent to a pressure responsive firing head. A piston rod element of the piston-cylinder mechanism projects beyond the bottom distal end of a perforating gun and firing head assembly.

At the bottom end of the well production tube or casing is a bore plug or packer. The projecting piston rod is axially aligned to engage the bore plug in support of the gun weight upon the plug and secured in place by one or more calibrated shear fasteners such as screws or pins.

As the gun weight is lowered onto the piston rod when abutted against the bore plug, the shear fasteners fail and the piston is displaced against a closed volume of well fluid in a cylinder volume between the piston head and the firing head pressure sensor.

As the gun weight lowered onto the piston rod when abutted against the bore plug, the shear pins fail and the piston is displaced against a closed volume of well fluid in a cylinder volume between the piston head and the firing head pressure sensor.

A safety sub is positioned in the gun assembly between the piston-cylinder sub and the firing head to prevent premature gun detonation as the assembly descends along the well bore. The safety sub comprises venting apertures in the high pressure cylinder volume to divert unintentionally or prematurely displaced fluid. Venting apertures in the safety sub housing are paired with apertures in a well pressure actuated piston sleeve.

Any premature displacement of the firing pressure piston displaces a corresponding volume of well fluid in to the surrounding well annulus. However, as the assembly approaches well bottom, in situ fluid pressure closes the safety sub apertures and permits the generation of detonation pressure against the firing head. A spring re-cocks the piston in the event of premature displacement so as to enable firing once the venting apertures are closed.

BRIEF DESCRIPTION OF THE DRAWINGS

The invention is hereafter described in detail and with reference to the drawings wherein like reference characters designate like or similar elements throughout the several figures and views that collectively comprise the drawings. Respective to each drawing figure.

DESCRIPTION OF THE PREFERRED EMBODIMENTS

As the description of the invention is developed hereafter, It should be understood that the term "tubing" as used herein may refer to drill pipe, completion tubing, production tubing, casing or other similar tubular members suitable for forming the flow paths described and illustrated herein. Similarly, unless identified otherwise, connections between tubular or housing members will be by way of conventional "pin" and "box" threaded couplings. Specification references to "up" and "down" are restricted to the descriptive purposes of drawing orientation and are not intended to be tool construction limitations.

Figure 1:
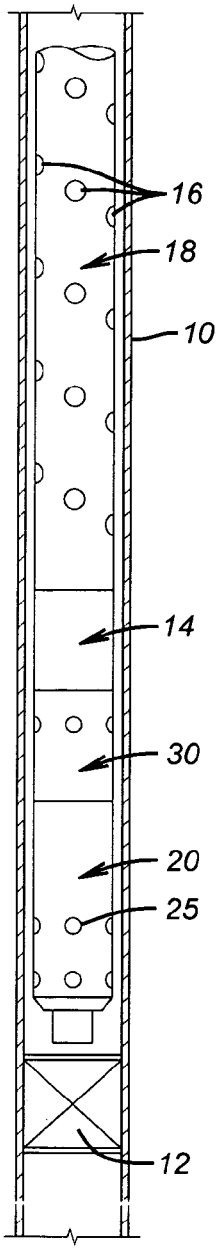
FIG. 1 is partial section of a well with the invention positioned proximate of the well bottom

FIG. 1 illustrates in partial section the lower distal end of a production tube 10 having the bottom end of a perforating gun assembly positioned within the tube bore. The lower end of the tube 10 is sealed by a packer or bottom hole bore plug 12. The perforating gun 14 comprises a multiplicity of shaped charges of explosive material 16. When detonated, these charges 16 explosively decompose with a linearly directed stream of high temperature gas. These high temperature gas streams perforate the walls of the tube 10 to provide fluid flow channels into the tube bore for in situ fluid flow up the tube to the surface.

The shaped charges are traditionally detonated by a primer cord, the initiation of which is generated by a low order percussion detonator. The detonator and percussion mechanism is assembled within the firing head 18 in a manner such as described in detail by U.S. Pat. No. 4,901,802 to F. R. George et al. In general, a free piston carried firing pin is secured within a cylinder by calibrated shear retainers such as pins or screws. One face of the piston is exposed to a high pressure fluid source whereas the opposite face of the piston is exposed to a sealed, low pressure volume. When the pressure differential between the opposite piston faces is sufficient to shear the calibrated retainers, the firing pin is abruptly translated against a percussion detonator to consequently ignite the primer cord.

Continuing the FIG. 1 description of the present invention, a pressure generating piston sub 20 is positioned at the distal end of the gun assembly. Between the piston sub 20 and the firing head 18 is a safety sub 30.

With respect to FIG. 2 and the piston sub 20, the firing pressure piston 22 is secured by calibrated shear fasteners such as pins or screws 23 at a retracted position of the piston face below cylinder relief apertures 25. Piston rod 24 is a reduced diameter extension from the piston 22 and projects beyond the distal end 28 of the tube wall 27. Venting apertures 26 below the piston 22 provide equalization pressure on the piston for well run-in. A helical spring 45 disposed within the extended cylinder bore 21 bears upon the face of piston 22 to bias the piston toward the retracted position shown. Configured as FIG. 2, all dynamic elements of the invention are pressure balanced.

Figure 2:
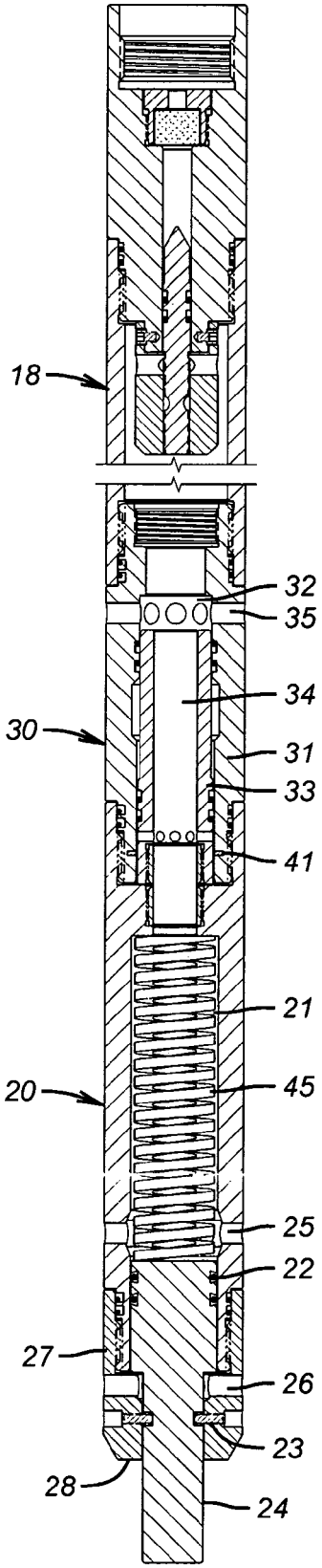
FIG. 2 is a section view of the invention prepared for well run-in and prior to operation.

In principle, the gun assembly is lowered along the well bore in the configuration represented by FIG. 2 until the distal end of the piston rod 24 engages the bottom hole bore plug 12. As those of ordinary skill in the arts of earth boring and well drilling are aware, however, there may be numerous obstacles, ledges and debris along the length of a well bore of sufficient weight and mass as to shear the calibrated shear fasteners 23 prematurely if correctly engaged by the projecting rod 24 as the assembly descends along the well bore toward the designated bottom. In recognition of such operational realities, a safety sub 30 is positioned between the firing piston sub 20 and the firing head 18.

Figure 3:
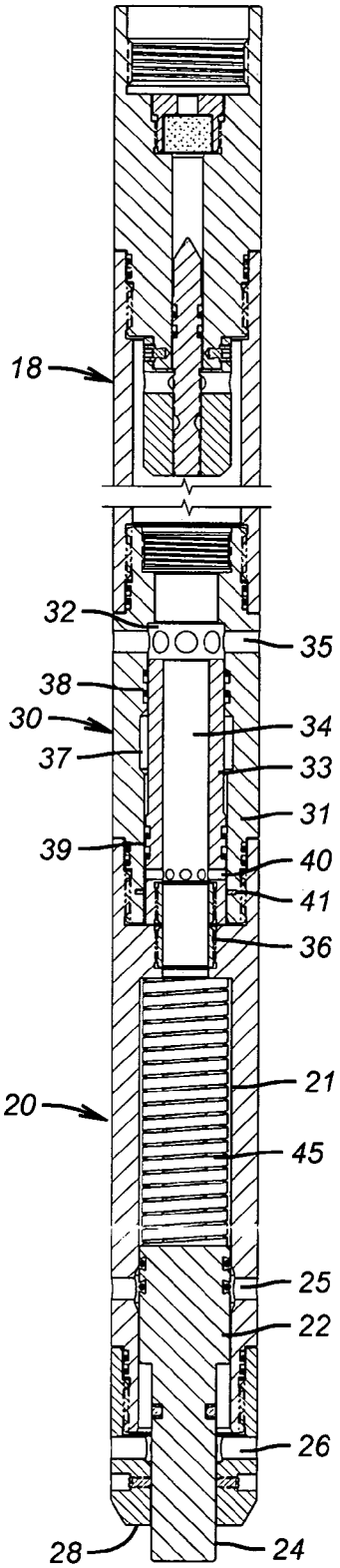
FIG. 3 is a section view of the invention showing the operational sequence following a premature displacement of the firing pressure piston.

As the weight of the gun is brought to bear against the obstacle and the calibrated shear fasteners 23 fail, the face of piston 22 compresses the spring 45 to rise in the cylinder bore 21 past the vent apertures 25 as shown by FIG. 3. The initial response to this piston movement is to displace well fluid in the cylinder 21 above the piston face through the vent apertures 25. However, as the face of piston 22 rises past the apertures 25, further fluid displacement is discharged through the safety sub apertures 35. Consequently, no activation pressure is developed against the firing head 18

With continued reference to FIG. 3, the safety sub 30 comprises a tubular housing 31 having strategically positioned and sized venting apertures 35. The central bore 32 of the housing 31 guides the axial translation of a hollow bore valve sleeve 33 having a greater outside diameter at the lower end seal zone 39 than that of the upper end seal zone 38. The length of the axial flow bore 34 extends past the upper end of the sleeve 33. So long as the sleeve is in the run-in position shown by FIG. 3, the venting apertures 35 are open between the axial flow bore 34 and the surrounding well annulus.

A cylindrical tension link 36 is secured to both, the valve sleeve 33 and the housing of piston sub 20 in coaxial alignment with the flow bore 34. The tension link 36 is circumferentially scored between the sleeve 33 and the piston sub housing 20 to separate in tensile failure at a predetermined pressure differential between the in situ well pressure and a reference chamber 37 surrounding valve sleeve 33 between upper and lower sleeve seal zones 38 and 39, respectively. Radial apertures 40 through the sleeve 33 wall provide pressure communication between the axial flow bore 34 and the external perimeter of the sleeve below the lower seal zone 39.

Figure 4:
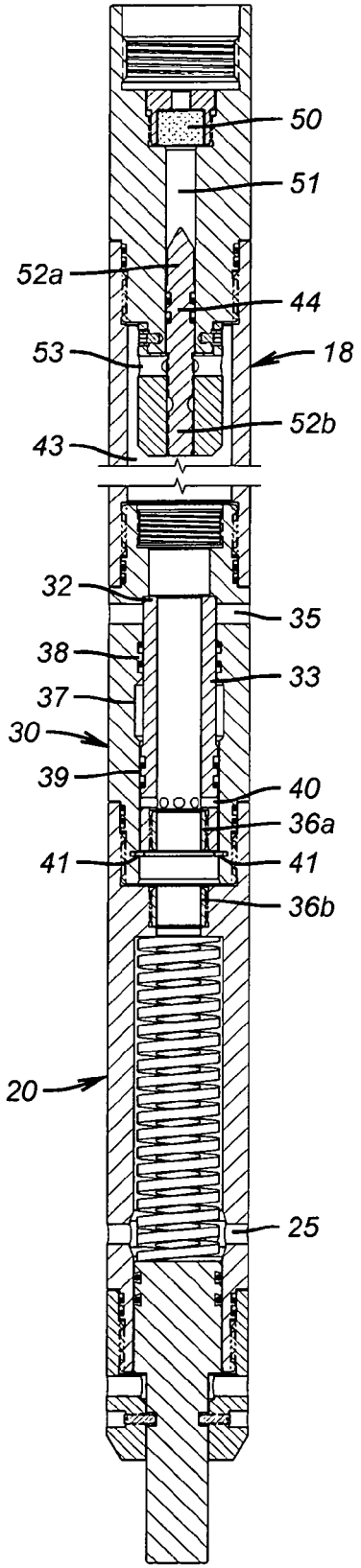
FIG. 4 is a section view of the invention showing distinctive operating events as a predetermined detonation depth is approached.

Operation of the safety sub 30 is best displayed by FIG. 4, which illustrates an upward shift of the valve sleeve 33 due to a tensile failure of the tension link 36. This upward translation of the sleeve 33 closes the venting apertures 35. When the tool reaches the bore depth and pressure corresponding to that pressure differential acting upon the upper and lower valve sleeve 33 diameters required to rupture the tension link 36, the severed link releases the valve sleeve 33 to shift upwardly and close the venting apertures 35. The upper portion of the tension link **36*a* secured to the valve sleeve 33 remains with the valve sleeve whereas the lower portion of the link 36*b*** remains with the piston sub housing.

When the valve sleeve 33 reaches the upper end of the central bore 32 to close the venting apertures 35, a spring biased C-ring 41 closes into the bore 32 space prevent the valve sleeve 33 from returning to its original position. The tool is now armed for the final detonation event.

Figure 5:
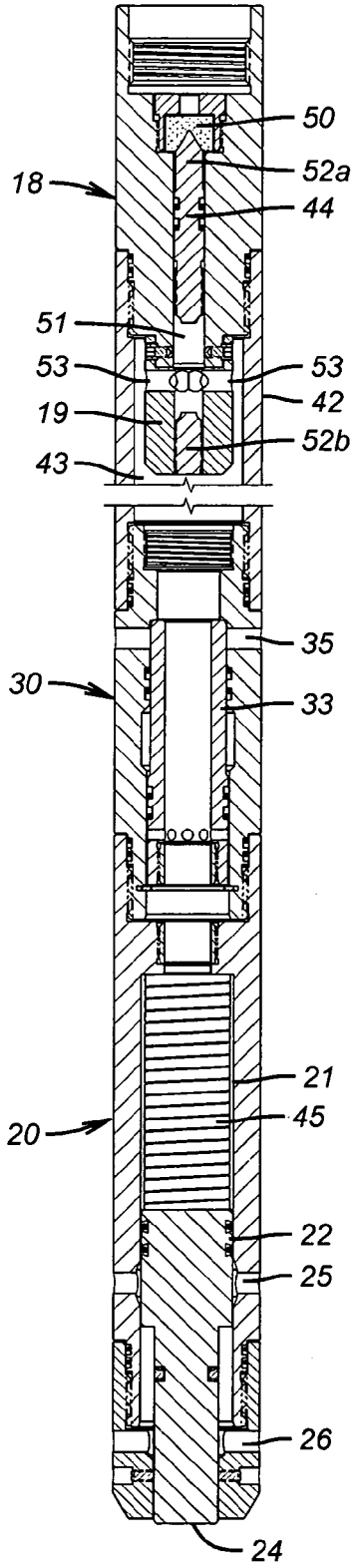
FIG. 5 is a section view of the invention showing distinctive operating events at the moment of firing head detonation.

Relative to FIG. 5, the final detonation event is engagement of the bottom hole bore plug 12 by the piston rod 24. As described with respect to FIG. 3, the piston is pushed against the bias of spring 45 past the venting apertures 25. The safety sub apertures 35 have been closed by the valve sleeve 33 and the static depth pressure of the in situ well bore fluid. With no path of release, the displacement force on the piston 22 forces an abrupt pressure increase in the well fluid trapped in the chamber space 43 between the head of piston 22 and the firing head 18.

Between the firing head 18 and the safety sub 30 may be an appropriate length of spacer subs 42 to position the perforating gun 14 opposite from the perforation zone above the bottom hole bore plug 12.

The firing head 18 comprises a percussion detonator 50 secured at the end of a barrel bore 51. Within the bore 51 is a tension stud firing pin 52 that is scribed between an anchor end **52*b* and percussion end. The anchor end 52*b* is firmly secured to the firing head boss 19. The percussion end 52*a* of the firing pin is of greater diameter than the anchor end 52*b* and is sealed by O-rings to the wall of barrel bore 51 at a zone 44 above the vent apertures 53** in the firing head boss.

The vent apertures 53 open the barrel bore 51 to the chamber space 43 at a point below the firing pin seal zone 44 and thereby expose the differential diameter annulus of the firing pin 52 to the extreme fluid pressure surge caused by the abrupt displacement of piston 22. This extreme pressure force ruptures the firing pin along the scribe line and drives the percussion end **52*a* into the detonator 50**.

An alternative embodiment of the invention may omit the venting apertures 26 around the piston rod 24, provide an O-ring seal zone around the rod 24 and an upper limit stop in the cylinder bore 21. In this configuration, in situ well pressure acting against the annular void below the piston head 22 and the rod 24 will drive the piston to the starting position after premature displacement.

Although the invention disclosed herein has been described in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. An explosive detonation sub for detonating explosive well tools, said sub comprising:

a cylindrical housing having an axially open fluid path between a detonator end and a piston end including a piston bore;

an axially translated piston within said piston bore that is resiliently biased toward a distal end of said piston bore;

a percussion detonator proximate of said detonator end;

a firing pin displaced by a fluid pressure pulse in said fluid path for detonating said detonator; and a piston rod projected from a piston end of said housing for displacing said piston to generate a fluid pressure pulse in said fluid path; and, a first aperture through a housing wall into said piston bore to vent a predetermined volume of fluid upon displacement of said piston prior to generation of said pressure pulse.

2. An explosive detonation sub for detonating explosive well tools as described by claim 1 comprising a second aperture through said housing wall into said fluid path.

3. An explosive detonation sub for detonating explosive well tools as described by claim 2 having a sliding valve sleeve for closing said second aperture.

4. An explosive detonation sub for detonating explosive well tools as described by claim 3 having fluid pressure responsive retainer means for securing said valve sleeve at an open second aperture position.

5. A method of detonating an explosive down hole well tool comprising the steps of:

coupling a firing head to a down hole end of an explosive well tool;

providing said firing head with a percussion detonator and a fluid pressure driven firing pin for striking said detonator;

coupling a cylinder sub to a down hole end of said firing head;

providing a piston in said cylinder sub to displace fluid into a fluid link with said firing pin;

providing a resilient bias against said piston;

providing a projection from said piston to project past a down hole distal end of said cylinder sub;

providing a first vent from said fluid link to discharge a predetermined volume of fluid displaced by an initial translation of said piston against said resilient bias due to engagement of said projection with a well bore obstacle; and, generating firing pin driving pressure in said fluid link after discharging said predetermined volume of fluid.

6. A method of detonating a down hole well tool as describe by claim 5 providing a second vent from said fluid link to discharge additional volume of fluid displaced by additional translation of said piston.

7. A method of detonating a down hole well tool as describe by claim 6 providing a second vent closure element responsive to a predetermined well environment pressure to close said second vent.

* * * * *